US008742950B2

(12) United States Patent
Schunder et al.

(10) Patent No.: US 8,742,950 B2
(45) Date of Patent: Jun. 3, 2014

(54) VEHICLE SPEED DATA GATHERING AND REPORTING

(75) Inventors: Mark Schunder, Dearborn, MI (US); Thomas J. Giuli, Ann Arbor, MI (US); Joseph N. Ross, Ann Arbor, MI (US); Joseph Paul Rork, Canton, MI (US); Thomas Richard Alexander, Canton, MI (US); Joseph Phillips, Bay City, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 537 days.

(21) Appl. No.: 13/038,454

(22) Filed: Mar. 2, 2011

(65) Prior Publication Data

US 2012/0223842 A1 Sep. 6, 2012

(51) Int. Cl.
*G08G 1/01* (2006.01)
*G08G 1/052* (2006.01)

(52) U.S. Cl.
CPC ..... *G08G 1/052* (2013.01)
USPC ..... 340/936; 701/532

(58) Field of Classification Search
CPC ..... G08G 1/052
USPC ..... 340/936, 995.1, 995.14, 995.19; 701/412, 532, 533
See application file for complete search history.

(56) References Cited

U.S. PATENT DOCUMENTS

| | | | |
|---|---|---|---|
| 5,781,125 | A | 7/1998 | Godau et al. |
| 5,922,041 | A | 7/1999 | Anderson |
| 6,064,322 | A | 5/2000 | Ohira |
| 6,337,621 | B1 | 1/2002 | Ogino et al. |
| 6,356,839 | B1 | 3/2002 | Monde et al. |
| 6,434,455 | B1 | 8/2002 | Snow et al. |
| 6,553,292 | B2 | 4/2003 | Kokes et al. |
| 6,598,183 | B1 | 7/2003 | Grieco et al. |
| 6,603,394 | B2 | 8/2003 | Raichle et al. |
| 6,611,740 | B2 | 8/2003 | Lowrey et al. |
| 6,636,790 | B1 | 10/2003 | Lightner et al. |
| 6,687,587 | B2 | 2/2004 | Kacel |
| 6,738,697 | B2 | 5/2004 | Breed |
| 6,778,888 | B2 | 8/2004 | Cataldo et al. |
| 6,978,198 | B2 | 12/2005 | Shi |

(Continued)

FOREIGN PATENT DOCUMENTS

| | | |
|---|---|---|
| EP | 0808492 | 8/1996 |
| JP | 9264819 | 10/1997 |

(Continued)

OTHER PUBLICATIONS

DrewTech gets you on the Bus, article printed from www.drewtech.com, Dec. 16, 2009.

(Continued)

*Primary Examiner* — John A Tweel, Jr.
(74) *Attorney, Agent, or Firm* — Jennifer M. Stec; Brooks Kushman P.C.

(57) ABSTRACT

A computer-implemented method includes recognizing the initiation of a vehicle journey. The method further includes periodically storing vehicle speed data, GPS coordinate data and time data. This method also includes providing at least one option for reporting the stored speed data, GPS data and time data. The method additionally includes outputting the stored speed data, GPS data and time data for at least one portion of the vehicle journey, responsive to input requesting the reporting.

20 Claims, 7 Drawing Sheets

(56) References Cited

U.S. PATENT DOCUMENTS

| | | | | |
|---|---|---|---|---|
| 7,146,307 | B2 | 12/2006 | Mocek | |
| 7,155,321 | B2 | 12/2006 | Bromley et al. | |
| 7,209,490 | B2 | 4/2007 | Isaac et al. | |
| 7,228,211 | B1 | 6/2007 | Lowrey et al. | |
| 7,232,962 | B2 | 6/2007 | Rynd | |
| 7,277,780 | B2 | 10/2007 | Meier-Arendt et al. | |
| 7,340,365 | B2 | 3/2008 | Wubbena et al. | |
| 7,343,526 | B2 | 3/2008 | Aditham | |
| 7,356,394 | B2 | 4/2008 | Burgess | |
| 7,366,934 | B1 | 4/2008 | Narayan et al. | |
| 7,379,541 | B2 | 5/2008 | Iggulden et al. | |
| 7,487,074 | B2 | 2/2009 | Ohtsu et al. | |
| 7,493,209 | B1 | 2/2009 | Altrichter et al. | |
| 7,522,995 | B2 * | 4/2009 | Nortrup | 701/425 |
| 7,532,962 | B1 | 5/2009 | Lowrey et al. | |
| 7,590,476 | B2 | 9/2009 | Shumate | |
| 7,905,815 | B2 * | 3/2011 | Ellis et al. | 701/532 |
| 7,983,839 | B2 * | 7/2011 | Sutardja | 701/412 |
| 8,024,111 | B1 | 9/2011 | Meadows et al. | |
| 8,103,443 | B2 * | 1/2012 | Kantarjiev et al. | 701/423 |
| 8,126,644 | B2 | 2/2012 | Amano | |
| 8,140,358 | B1 | 3/2012 | Ling et al. | |
| 8,185,299 | B2 | 5/2012 | Fujiwara et al. | |
| 8,219,249 | B2 | 7/2012 | Harrod et al. | |
| 8,285,439 | B2 | 10/2012 | Hodges | |
| 8,315,802 | B2 | 11/2012 | Brown | |
| 8,364,402 | B2 | 1/2013 | Ross et al. | |
| 8,390,473 | B2 | 3/2013 | Krzyzanowski et al. | |
| 8,392,105 | B2 | 3/2013 | Desborough | |
| 2002/0035429 | A1 | 3/2002 | Banas | |
| 2002/0173885 | A1 | 11/2002 | Lowrey et al. | |
| 2003/0034769 | A1 | 2/2003 | Lipscomb et al. | |
| 2003/0036832 | A1 | 2/2003 | Kokes et al. | |
| 2003/0163587 | A1 | 8/2003 | Knight et al. | |
| 2004/0024502 | A1 | 2/2004 | Squires et al. | |
| 2004/0044454 | A1 | 3/2004 | Ross et al. | |
| 2004/0054503 | A1 | 3/2004 | Namaky | |
| 2004/0093134 | A1 | 5/2004 | Barber et al. | |
| 2004/0128071 | A1 | 7/2004 | Schradi | |
| 2004/0172177 | A1 | 9/2004 | Nagai et al. | |
| 2004/0194479 | A1 | 10/2004 | Umebayashi et al. | |
| 2004/0218894 | A1 * | 11/2004 | Harville et al. | 386/46 |
| 2005/0090939 | A1 | 4/2005 | Mills et al. | |
| 2005/0096020 | A1 | 5/2005 | Oesterling | |
| 2005/0097541 | A1 | 5/2005 | Holland | |
| 2005/0192724 | A1 | 9/2005 | Hendry | |
| 2005/0281414 | A1 | 12/2005 | Simon et al. | |
| 2006/0034231 | A1 | 2/2006 | Tailor | |
| 2006/0041348 | A1 | 2/2006 | Liebl et al. | |
| 2006/0130033 | A1 | 6/2006 | Stoffels et al. | |
| 2006/0132291 | A1 | 6/2006 | Dourney, Jr. et al. | |
| 2006/0155437 | A1 | 7/2006 | Wang et al. | |
| 2006/0229777 | A1 | 10/2006 | Hudson et al. | |
| 2006/0253235 | A1 | 11/2006 | Bi et al. | |
| 2007/0121959 | A1 | 5/2007 | Philipp | |
| 2007/0162796 | A1 | 7/2007 | Chan et al. | |
| 2007/0171029 | A1 | 7/2007 | Inbarajan | |
| 2007/0179799 | A1 | 8/2007 | Laghrari | |
| 2008/0015748 | A1 | 1/2008 | Nagy | |
| 2008/0027605 | A1 | 1/2008 | Oesterling | |
| 2008/0027606 | A1 | 1/2008 | Helm | |
| 2008/0082226 | A1 | 4/2008 | Amador et al. | |
| 2008/0140281 | A1 | 6/2008 | Morris et al. | |
| 2008/0147267 | A1 | 6/2008 | Plante et al. | |
| 2008/0162033 | A1 * | 7/2008 | Wagner et al. | 701/201 |
| 2008/0167056 | A1 | 7/2008 | Gilzean et al. | |
| 2008/0167078 | A1 | 7/2008 | Eibye | |
| 2008/0172357 | A1 | 7/2008 | Rechis et al. | |
| 2008/0216067 | A1 | 9/2008 | Viling | |
| 2008/0269975 | A1 | 10/2008 | Bertosa et al. | |
| 2009/0063038 | A1 | 3/2009 | Shrivathsan et al. | |
| 2009/0063045 | A1 | 3/2009 | Figueroa et al. | |
| 2009/0143937 | A1 | 6/2009 | Craig | |
| 2009/0177352 | A1 | 7/2009 | Grau et al. | |
| 2009/0210145 | A1 | 8/2009 | Amano | |
| 2009/0276115 | A1 | 11/2009 | Chen | |
| 2009/0292416 | A1 | 11/2009 | Ubik et al. | |
| 2009/0308134 | A1 | 12/2009 | Pepper | |
| 2009/0326757 | A1 | 12/2009 | Andreasen et al. | |
| 2009/0326991 | A1 | 12/2009 | Wei et al. | |
| 2010/0042287 | A1 | 2/2010 | Zhang et al. | |
| 2010/0042288 | A1 | 2/2010 | Lipscomb et al. | |
| 2010/0056055 | A1 | 3/2010 | Ketari | |
| 2010/0204878 | A1 | 8/2010 | Drew et al. | |
| 2010/0245123 | A1 | 9/2010 | Prasad et al. | |
| 2010/0246846 | A1 | 9/2010 | Burge et al. | |
| 2010/0256861 | A1 | 10/2010 | Hodges | |
| 2010/0262335 | A1 | 10/2010 | Brozovich | |
| 2011/0022422 | A1 | 1/2011 | Taylor | |
| 2011/0041088 | A1 | 2/2011 | Mason et al. | |
| 2011/0046883 | A1 | 2/2011 | Ross et al. | |
| 2011/0190962 | A1 | 8/2011 | Peterson et al. | |
| 2011/0225096 | A1 | 9/2011 | Cho et al. | |
| 2011/0258044 | A1 | 10/2011 | Kargupta | |
| 2011/0276218 | A1 | 11/2011 | Dwan et al. | |
| 2011/0276219 | A1 | 11/2011 | Swaminathan et al. | |
| 2012/0029762 | A1 | 2/2012 | Ubik et al. | |
| 2012/0030512 | A1 | 2/2012 | Wadhwa et al. | |
| 2012/0053782 | A1 | 3/2012 | Gwozdek et al. | |
| 2012/0072055 | A1 | 3/2012 | Barlsen et al. | |
| 2012/0075092 | A1 | 3/2012 | Petite et al. | |
| 2012/0294238 | A1 | 11/2012 | Uhler | |

FOREIGN PATENT DOCUMENTS

| | | | |
|---|---|---|---|
| JP | 9264819 | A | 10/1997 |
| JP | 11326140 | | 11/1999 |
| JP | 11326140 | A | 11/1999 |
| JP | 2006018680 | | 1/2006 |
| JP | 2006018680 | A | 1/2006 |

OTHER PUBLICATIONS

The CarDAQ-Plus Advantage, Drew Technologies, Inc, Jul. 2012.

Integrated Diagnostic System (IDS), Ford, Lincoln, Mercury , Jul. 2012.

Pegisys PC Diagnostic System, PC-based J2534 Reprogramming & Scan Tool, printed from www.otctools.com, Jul. 2012.

CarDAQ-Plus, Drew Technologies, Inc, Jul. 2012.

Kermit Whitfield, "A hitchhiker's guide to the telematics ecosystem", Automotive Design & Production, Oct. 2003, http://findarticles.com, pp. 1-3.

Dynetics Vehicle Data Recorder Models DVG-II and WDVG-II (2009) printout from www.dynetics-ia.com.

Ford Motor Company, "SYNC with Navigation System," Owner's Guide Supplement, SYNC System Version 1 (Jul. 2007).

Ford Motor Company, "SYNC," Owners's Guide Supplement, SYNC System Version 1 (Nov. 2007).

Ford Motor Company, "SYNC with Navigation System," Owner's Guide Supplement, SYNC System Version 2 (Oct. 2008).

Ford Motor Company, "SYNC," Owner's Guide Supplement, SYNC System Version 2 (Oct. 2008).

Ford Motor Company, "SYNC with Navigation System," Owner's Guide Supplement, SYNC System Version 3 (Jul. 2009).

Ford Motor Company, "SYNC," Owner's Guide Supplement, SYNC System Version 3 (Aug. 2009).

"Drew Tech gets you on the Bus", article printed from www.drewtech.com, Dec. 16, 2009.

Dynetics Vehicle Data Recorder Models DVG-II and WDVG-II printout from www.dynetics-ia.com, Jul. 2013.

Integrated Diagnostic System (IDS), Ford, Lincoln, Mercury, Jul. 2013.

Introduction to J2534 and Flash Reprogramming, Drew Technologies, Copyright 2009.

Pegisys PC Diagnostic System, PC-based J2534 Reprogramming & Scan Tool, printed from www.otctools.com, Jul. 2013.

Software, Pass Thru Pro II, J2534 Flash Reprogramming, printed from buy1.snapon.com, Dec. 3, 2009.

SYNC Navigation System (Jul. 2007).

(56) References Cited

OTHER PUBLICATIONS

SYNC Navigation System (Jul. 2009).
SYNC Navigation System (Oct. 2008).
SYNC Supplemental Guide (Oct. 2008).
SYNC Supplemental Guide (Aug. 2009).
SYNC Supplemental Guide (Nov. 2007).
The CarDAQ-Plus Advantage, Drew Technologies, Inc, Jul. 2013.

* cited by examiner

VEHICLE SPEED DATA GATHERING AND REPORTING

BACKGROUND

The illustrative embodiments generally relate to methods and apparatuses for vehicle speed data gathering and reporting.

We live in a world of hurry. With countless demands on our time, people are constantly rushing about to get from appointment to appointment. If someone has fifteen minutes to travel fifteen miles, they will often attempt to average a vehicle speed of sixty miles an hour over that distance. This, quite naturally, can present a problem, if the legal speed limit is somewhat less than sixty miles per hour.

Or, it may be the case that a good deal of the journey is made on an interstate, where speeds can permissibly exceed sixty miles an hour, but in the transition from interstate to surface road the person may inadequately decelerate the vehicle, and travel at a legally excessive speed for some portion of the transition. Never is this untenable position made more clearly existent than when the dreaded flashing lights of a police vehicle are seen in the rearview mirror.

Almost everyone has been in the position of being stopped for speeding at one point or another. Further, since in many of those cases, the driver has absolutely no idea at what exact point the police officer tagged them with a radar gun, the driver is left with little response when asked the question "do you know how fast you were going?"

But roads are crowded arteries, and it is possible that the police officer tracked the speed of a vehicle next to or nearby the driver. Further, it is simply possible that the police officer's equipment was inaccurate. Finally, some techniques for measuring speed are imprecise, such as a guess based on a visual observation or a guess based on the present speed of a traveling police vehicle.

Unfortunately for the driver, even if the police officer was mistaken in an assessment of speed, or simply tracked the wrong vehicle, the driver typically has little to no evidence to fall back on.

Speed data may be useful for other purposes as well. If a driver knows typically how fast the driver is traveling between two points, an assessment can be made as to whether or not a destination can be achieved within a certain timeframe. Additionally, many young drivers have a tendency to drive at excessive speeds, which, especially when combined with a lack of experience at driving, may lead to dangerous conditions. Parents have an interest in knowing at what speeds their children are traveling in family vehicles or when newly driving.

In another instance, if an accident occurs, both parties will often accuse the other parties of violating one or more traffic regulations, in an effort to show their own innocence in the matter. In situations such as this, unless there are believable witnesses, justice is forced to rely on a decision based on observations that are likely inaccurate and almost certainly self-serving.

SUMMARY

In a first illustrative embodiment, a computer-implemented method includes recognizing, via a vehicle computing system (VCS), the initiation of a vehicle journey. The method further includes periodically storing, via the VCS, vehicle speed data, GPS coordinate data and time data. This illustrative method also includes providing, via the VCS, at least one option for reporting the stored speed data, GPS data and time data. The illustrative method additionally includes outputting the stored speed data, GPS data and time data, via the VCS, for at least one portion of the vehicle journey, responsive to input requesting the reporting.

In a second illustrative embodiment, a vehicle computing apparatus includes recognizing programmed logic circuitry to recognize the initiation of a vehicle journey. The illustrative apparatus also includes storing programmed logic circuitry to periodically store vehicle speed data, GPS coordinate data and time data. The illustrative apparatus further includes providing programmed logic circuitry to provide at least one option for reporting the stored speed data, GPS data and time data. The illustrative apparatus additionally includes outputting programmed logic circuitry to output the stored speed data, GPS data and time data for at least one portion of the vehicle journey, responsive to input requesting the reporting.

In a third illustrative embodiment, a computer readable storage medium, stores instructions that, when executed, cause a vehicle computing system (VCS) to perform the method including recognizing the initiation of a vehicle journey. The illustrative method also includes periodically storing vehicle speed data, GPS coordinate data and time data. The illustrative method further includes providing at least one option for reporting the stored speed data, GPS data and time data. Additionally, the illustrative method includes outputting the stored speed data, GPS data and time data for at least one portion of the vehicle journey, responsive to input requesting the reporting.

DETAILED DESCRIPTION

Figure 1:
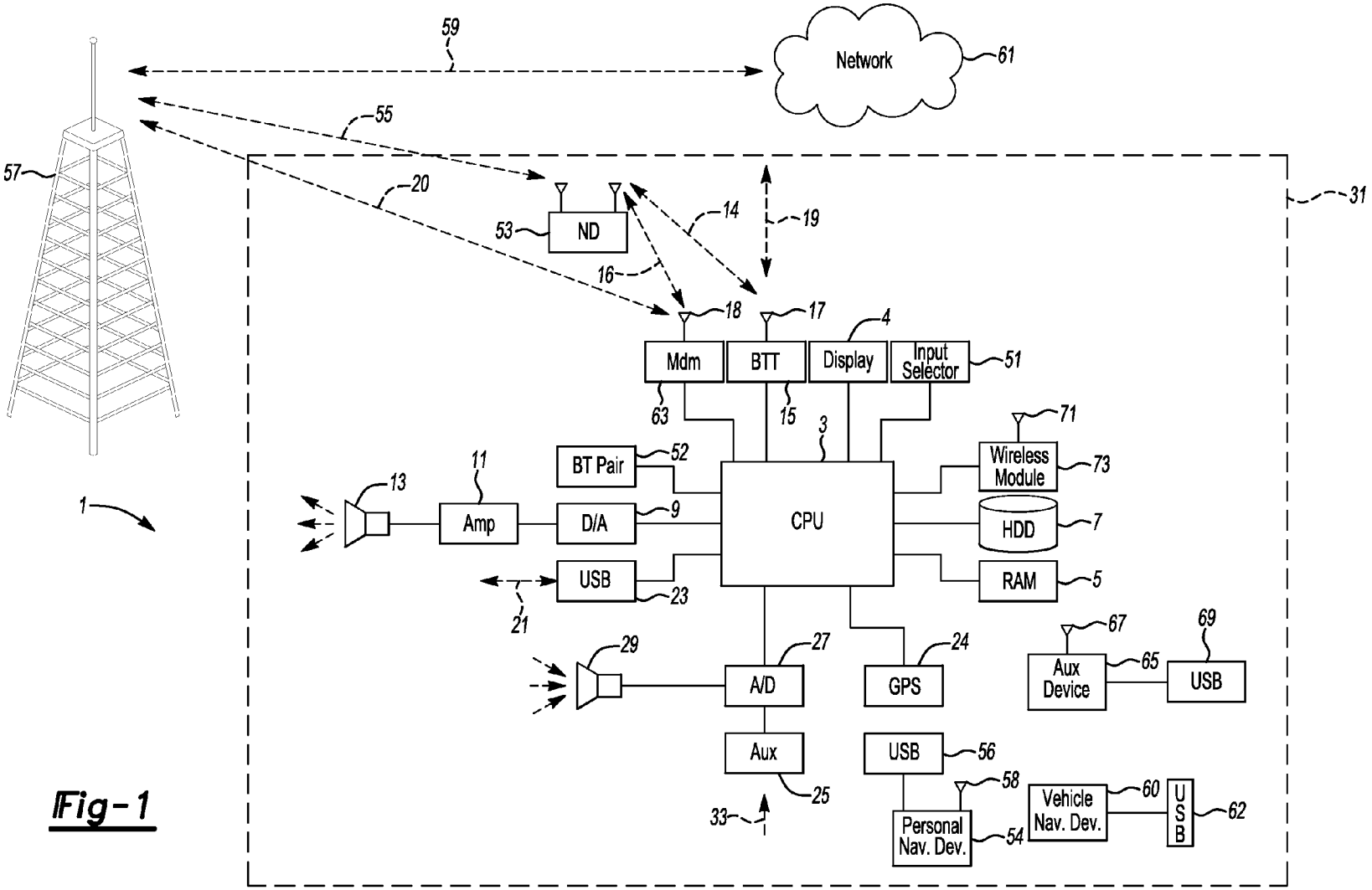
FIG. 1 shows an illustrative example of a vehicle computing system and a remote network.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, audible speech and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory.

The processor is also provided with a number of different inputs allowing the user to interface with the processor. In this illustrative embodiment, a microphone 29, an auxiliary input 25 (for input 33), a USB input 23, a GPS input 24 and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device).

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example).

If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58; or a vehicle navigation device 60, having a USB 62 or other connection, an onboard GPS device 24, or remote navigation system (not shown) having connectivity to network 61.

Further, the CPU could be in communication with a variety of other auxiliary devices 65. These devices can be connected through a wireless 67 or wired 69 connection. Also, or alternatively, the CPU could be connected to a vehicle based wireless router 73, using for example a WiFi 71 transceiver. This could allow the CPU to connect to remote networks in range of the local router 73. Auxiliary device 65 may include, but are not limited to, personal media players, wireless health devices, portable computers, and the like.

In at least one illustrative embodiment, a vehicle is equipped with the capability to capture speed at periodic intervals, record captured speeds, and report those speeds back to a driver in a variety of formats. Speed capture may be time based, so as to map speeds over a route, and it may additionally or alternatively be recorded at points where certain speeds are exceeded and/or new maximum speeds are achieved.

The illustrative vehicle computing system is capable of pulling current speed information off of a vehicle network, such as, but not limited to, a CAN bus. This data can be tracked, stored, and analyzed as needed. Additionally, if a situation arises where speed data would be useful as evidence that an event did or did not occur, the recorded speed data could be presented.

Figure 2:
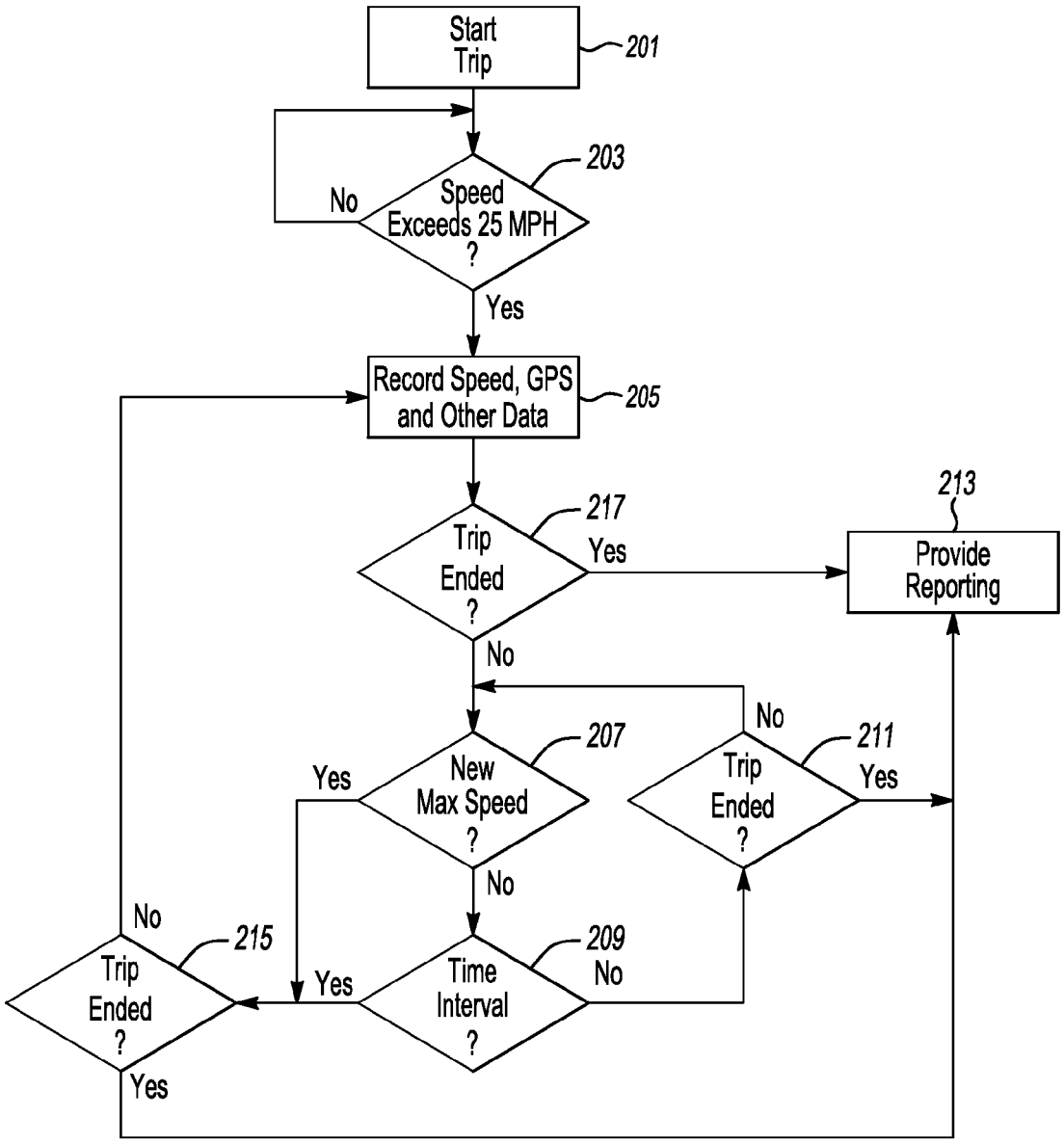
FIG. 2 shows an illustrative example of a general speed tracking process.

FIG. 2 shows an illustrative example of a general speed tracking process. In this illustrative embodiment, a vehicle computing system notices that a trip has begun 201. Since it is possible for a driver to simply move a vehicle, or travel to a mailbox or other short distance, it may be preferable, although not necessary, to delay speed tracking until, for example, at least a predetermined distance has been traveled (thus defining the start of a trip). On the other hand, it is also possible to begin speed tracking immediately, since it is possible that an event requiring speed data recall may occur even within a short distance of the home.

In this illustrative embodiment, the vehicle computing system waits 203 until a speed exceeds 25 mph. This 25 mph limit is set for example purposes only, to show that the tracking may not ensue until a certain speed is obtained. Alternatively, it would be possible to immediately begin tracking speed at periodic and/or new maximum speed points.

Once 25 mph has been exceeded, in this example, the vehicle speed is recorded in at least a temporary memory. In this illustrative embodiment the speed is recorded temporarily, in a local memory, and the driver is provided with an option to record the speed, view the speed, upload the speed, etc. at a later point. Additionally or alternatively, the vehicle computing system could immediately record the speed to local permanent storage, record the speed to a removable storage device, upload the speed to a remote server, upload the speed to a connected wireless device, etc.

In addition to recording the speed, in this illustrative embodiment both vehicle GPS location and current time are stored. Additional vehicle statistics could be stored as well. This further data will aid in reporting the speed and will also aid in a review of speeds at particular times and locations. For example, without limitation, if a user was stopped for allegedly speeding, using GPS data and/or time data, the user could review recorded speeds at the purported place/time of the incident to see if the accusation was accurate. This could aid the user in deciding whether or not to contest an issued ticket, and further it could provide the user with tangible evidence of innocence.

In another illustrative example, a parent may wish to know how fast their child was driving between the hours of 8 and 10 PM, when a family car was being used. Since the time data is recorded with the speed, the parent need not know the location of the vehicle to ask for a report on how fast the vehicle was traveling between two time points, or at a certain time.

Once the initial speed and vehicle data measurement has been saved 205, the system checks for a new maximum speed 207. Typically, since a vehicle will start a journey at 0 mph, there will be a number of "maximum" points leading up to the achievement of a speed at or near a current speed limit. At this point, data will more or less settle into a state of being recorded at intervals, until a faster road is reached, at which point the data will likely accrue more quickly again until the new speed limit is reached.

This is just one illustrative example of a system for gathering speed data. The data could also simply be gathered periodically, it could be continuously or near-continuously recorded, it could be recorded every time a particular threshold is passed, etc., and some or all of the methods of gathering could be done in conjunction, as is appropriate for a system.

At the time of recording, speed data, GPS data and time data may be recorded. Additionally, other vehicle data may also be recorded if desired. This additional vehicle data may include, but is not limited to, RPM data, steering wheel angle data, wheel speed data, etc.

In this embodiment, if a new maximum speed is achieved 207, the speed and other vehicle data is recorded 205 and the system again checks for a new maximum speed 207. If there is no new maximum speed 207, then the system checks to see if a time interval has passed (for periodic recording) 209). If the time interval has passed, then the system again records the vehicle speed and vehicle data.

At points throughout this exemplary process, the vehicle computing system checks to see if a trip has ended 211, 215, 217. If the trip has not ended, the process continues recording speed and vehicle data as described. When the trip ends, the vehicle computing system provides an option for reporting data 213. One non-limiting example of this is shown with respect to FIG. 4.

Although this illustrative embodiment shows the data reporting option, it may be the case that the trip ends unexpectedly (an accident) or abruptly (a quick stop and key-off). In situations such as this, assuming the data was not already stored in local permanent storage or off-board in permanent storage, the vehicle computing system may attempt to permanently store the data in one or more locations for later retrieval.

Additionally, a driver could request a warning from the vehicle if a certain speed is exceeded. Speeds could be set for a given route, or just set with respect to a particular instance on a journey. For example, if a route from home to the office was pre-saved into the vehicle computing system, it could also have speed limits associated therewith, and the driver could request warnings whenever those speeds were exceeded. On the other hand, a driver may choose to set a warning threshold at any point along any journey, either in advance or while the journey is in progress.

Figure 3A:
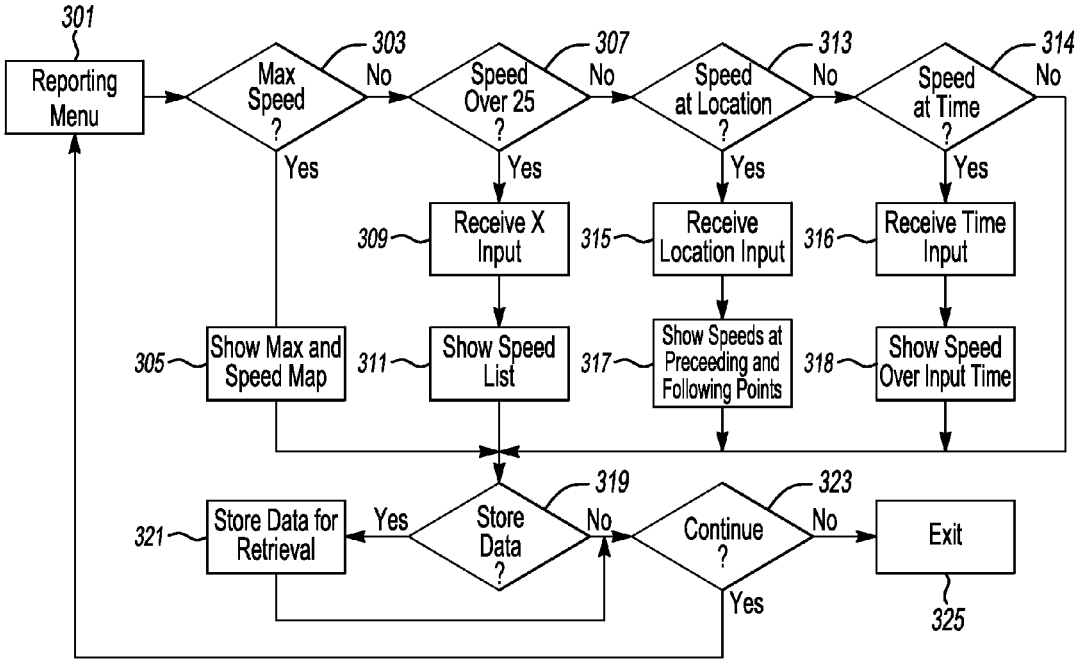
FIGS. 3A and 3B show illustrative examples of speed reporting processes.
Figure 3B:
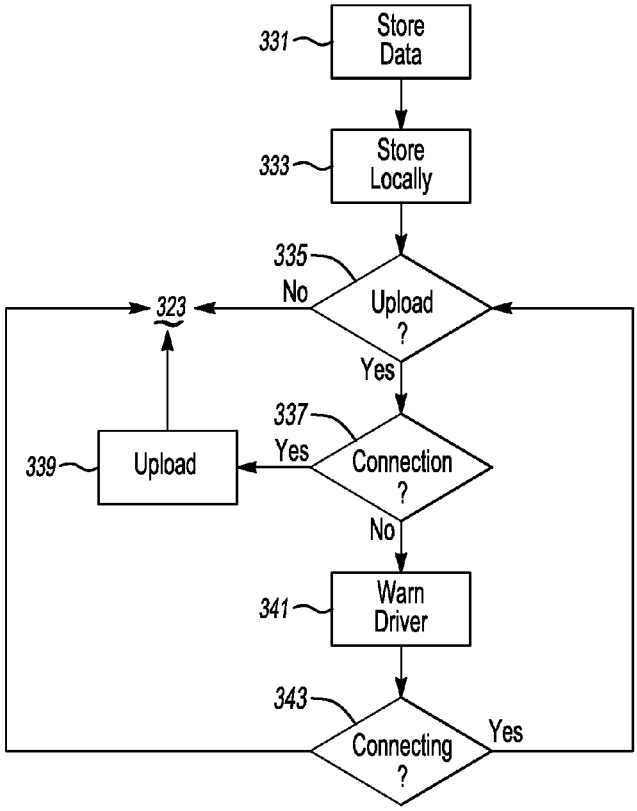

FIGS. 3A and 3B show illustrative examples of speed reporting processes. In the illustrative example shown in FIG. 3A, the vehicle computing system outputs a reporting menu, such as, but not limited to, the example shown in FIG. 5.

From this menu, the driver may select a variety of reporting options. For example, in this embodiment, the vehicle computing system detects if a driver wishes to view a maximum speed point 303.

If the driver selects the maximum speed point option, the vehicle computing system will examine the data from the trip and display a maximum point of speed and, in this embodiment, a map 305. Of course, such a display requires some form of in-vehicle display, or that the data is being viewed on a device with a display (nav display, wireless device, off-board computer, etc.). If no display is available, the speed data menu can be verbally output to the driver and corresponding reporting can also be done over, for example, the vehicle audio system. One non-limiting example of a visual output is shown with respect to FIG. 7.

As another alternative, in this example, the vehicle computing system detects if the driver wishes to view all speeds exceeding X 307. If the driver selects this option, the vehicle computing system receives an input speed of X 309. The vehicle computing system may then display all points where the vehicle speed exceeded the input number 311. Further, each of these points may be individually selectable for a more accurate reporting of data/time/location where and when this speed was exceeded and what the speeds surrounding the instance were. One non-limiting example of this is shown with respect to FIG. 8.

As a third option in this process, the vehicle computing system may detect that a driver wishes to know a speed at a certain location 313. If the driver selects this option, the vehicle computing system receives a location input 315. This input could be, but is not limited to, a crossroads, a mile marker (such as on a freeway), a GPS location, etc. In this instance, the speed at the location, and speeds at nearby locations (within a predetermined or input distance preceding and following the location) may be output 317. A non-limiting example of this display is shown with respect to FIGS. 6A and 6B.

As still another option, the vehicle computing system may detect that a driver desires to know a speed at a particular time 314. If the driver selects this option, the vehicle computing system may receive a time input 316 or a time range input.

If a single time is input, the vehicle computing system may report as if a single GPS position had been input. That is, the system may show the speed at that time, as well as speeds a distance or time preceding and following that point. If a time range is input, the vehicle computing system may show the speeds between the input time.

Since all of the speed data for the journey is presumably available to the vehicle computing system, an output display of vehicle speeds may be navigable in both time and space.

That is, a user presented with output may choose to move backwards and forwards in the output over a time period or a geographic period. If such a selection is made, the vehicle computing system may adjust the display accordingly. Additionally, it is possible for the user to zoom in and out in both a temporal and a spatial sense, in a similar fashion.

For example, without limitation, if a user wished to display the speeds between 9:50 and 10:00 PM, the system may first display speeds over this range. The user may then be able to zoom out to show a wider area, or zoom out to show a wider time range. Zooming or moving based on time may actually result in the same or a similar portion of the map being displayed, since it is possible for the vehicle to have been stationary over a given range. For example, if the user was at a stop-light from 9:48-9:50 PM and from 10:00-10:02 PM, moving the map backwards or forwards two minutes or zooming out four minutes would show the same geographic map (although additional speed data about the stationary condition may be displayed).

Other display options not shown are also available. For example, as shown with respect to FIG. 5, a user may choose to see all points where a speed was between X and Y (X and Y being predefined or dynamically input). Or an easy menu for common speed limits may be shown and the user can select to see all speeds exceeding a predefined limit (typically a multiple of 5). Any suitable reporting that may be done with the stored data is considered to be within the scope of this invention.

Once an output format is selected (or not selected) and the system has displayed (or not displayed) an output, the vehicle computing system detects whether a data-store is desired 319. Since hundreds, if not thousands, of trips are made in a vehicle without incident, a user may not frequently desire to store data and waste available storage space. If storage is desired, then the vehicle computing system stores the data 321 and determines whether or not the user wishes to continue with output 323. If not, the system exits.

Data storage may be done to, for example, without limitation, a local HDD or other resilient storage, a connected wireless device, an offboard server for later retrieval, etc. FIG. 3B shows an illustrative example of a storage process.

In this illustrative embodiment, once storage is selected 331 (or automatically implemented), the vehicle computing system first stores the data locally 333 (assuming this option is available). The system then determines whether or not the data should be uploaded to a remote location 335. If no upload is required, the system continues 323. If an upload is requested or pre-set to automatically occur, the system determines if a connection to the remote source exists 337.

If there is no connection to the remote source, the vehicle computing system warns the driver 341 and then checks to see if the driver has facilitated a connection to the remote source 343. If the driver has not, the system, perhaps after a predetermined period of time, simply continues 323. If a connection to the remote source (server, wireless device, etc.) has been made 337, the system uploads the data 339 and then continues. 323.

Figure 4:
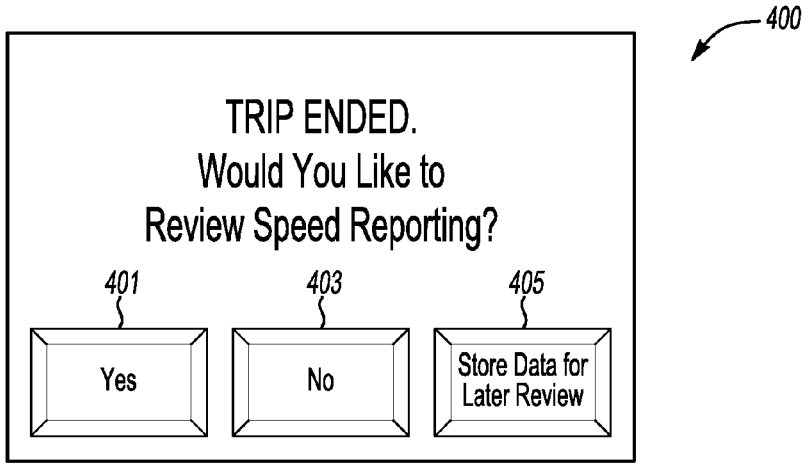
FIG. 4 shows an illustrative example of a speed reporting initiation display.

FIG. 4 shows an illustrative example of a speed reporting initiation display. In this illustrative example, the vehicle computing system has, for example, detected an end-of-trip condition. In response to this (or other appropriate) condition, the system outputs display 400 (or verbally asks the driver, if no display is available for use).

This example is relatively simple, providing the driver with the option to review speed data 401, not review speed data 403, and save speed data for later review 405. If option 403 is selected, and data is to be discarded, an additional warning may be provided to the driver before the data is deleted.

It may also be possible to power this display briefly even if the vehicle is keyed-off, so that the driver has an option to save the data at least, if the driver forgets to address this menu before exiting the vehicle. In at least one instance, once the brief powering continuation has expired, the data is deleted (or automatically saved) so that the driver does not need to address this menu each time the vehicle is exited. Of course, the recording option can also be enabled/disabled at a driver's behest.

Figure 5:
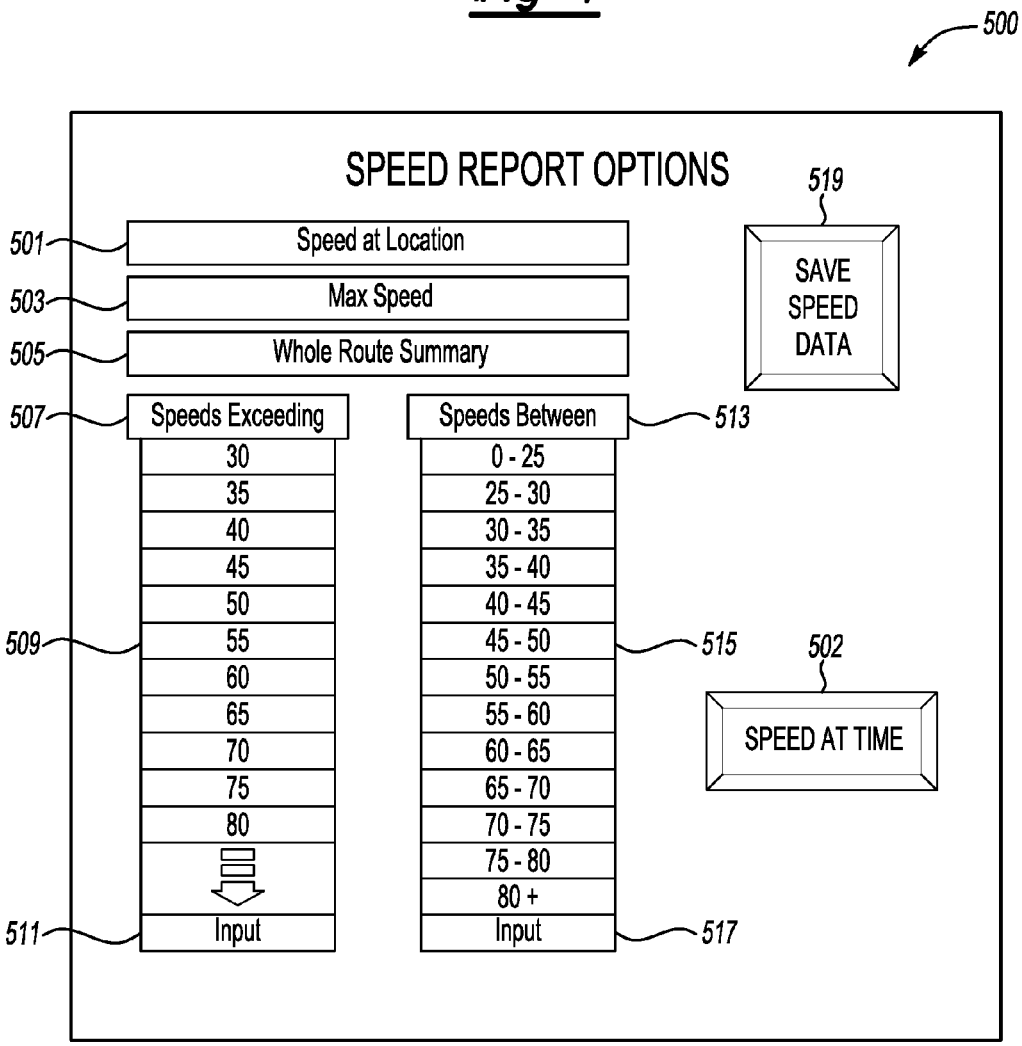
FIG. 5 shows an illustrative example of a speed reporting option menu.

FIG. 5 shows an illustrative example of a speed reporting option menu 500. In this illustrative embodiment, a variety of exemplary, non-limiting speed reporting options are shown. These examples are provided for illustrative purposes only and are not intended to limit the scope of the invention.

As one option, the driver has the ability to select a report of a speed or speeds at or near a particular location 501. The location could be identified, for example, by reference to cross roads, an address, a GPS location, a highway mile marker or exit, etc.

Additionally, in this embodiment, the driver may select a report of speed at a particular time or times. This will result, in this example, in an output of a speed or speeds at a time or range of times. Location data may also be output by the vehicle computing system.

As another option, the driver has the ability to select a speed report of maximum speed 503. In one illustrative embodiment, this will result in the output of the location at which the maximum speed was achieved, along with accompanying information such as time of day and actual speed.

Still another option in this embodiment is a whole route summary 505. Requesting this option may result in the output of the driver's entire route, with speeds and/or times shown periodically throughout the route. Data points may further include information such as the average speed between a data point and the previous data point (or two bracketing data points, etc.).

Additional options include speeds above specific levels 507. Selecting this option may result in a drop down menu (or audible output of a selection menu) 509. In this embodiment, the drop down menu contains common speed limits. Or the driver may input a speed 511. Similarly, the driver may request speeds between common limits 513 (or driver input limits 517). Selection of this option may result in the output of a variety of limits, between which speeds will be shown if that limit range is selected.

Finally, in this illustrative embodiment, the driver may select an option to simply save the speed data 519. This can be done initially, as a final action, or at any point after some measure of review or analytics have been performed.

Figure 6A:
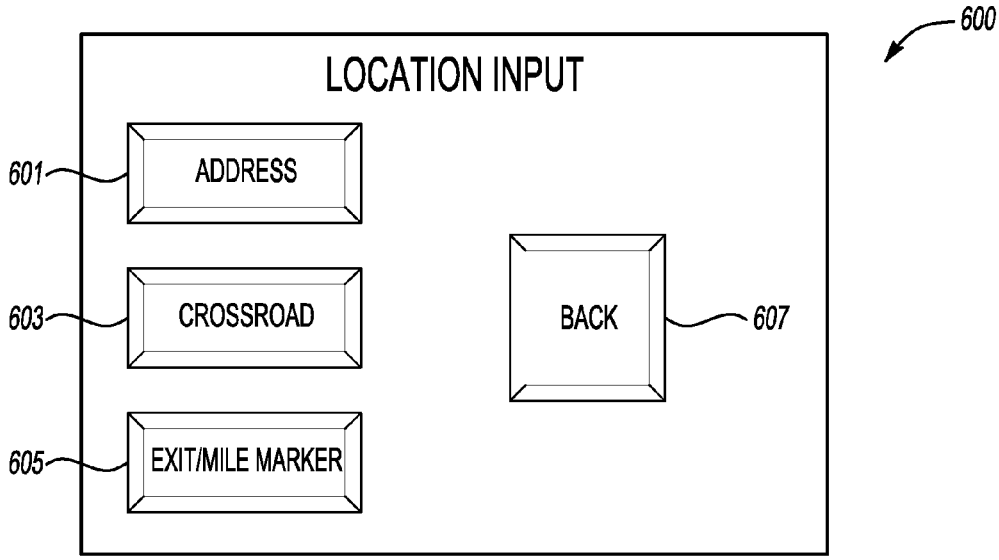
FIGS. 6A and 6B show illustrative examples of a speed reporting at location process display.
Figure 6B:
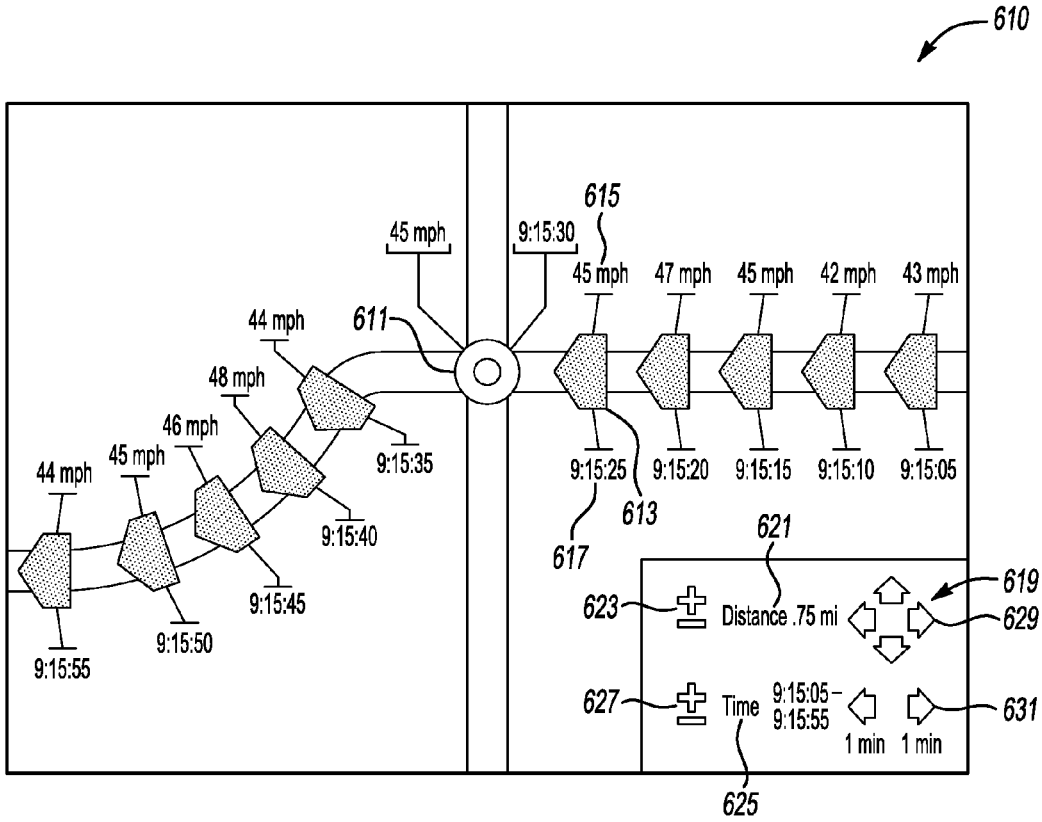

FIGS. 6A and 6B show illustrative examples of a speed reporting at location process display 600 and 610. In this illustrative example, the driver has selected to view a speed at a particular location. As a non-limiting set of options, in this example, the driver can input an address 601, a cross road 603, or a highway exit or mile marker 605. The driver also may elect to return to the previous menu 607.

FIG. 6B shows an illustrative example of a visual output 610 of a speed at a location request result. In this illustrative example, the location is designated by marker 611. Additionally, in this example, leading up to and following the location marker 611, a number of additional markers 613 at which speed readings were taken are shown. Selection of any of these markers may make that marker the new location marker 611. Also, in conjunction with each marker, a speed 615 and time of day 617 are reported.

In this illustrative example, the driver also has the option to navigate along the route using navigation options 629 and 631. Option 629 will allow the driver to navigate in terms of space (geographically) and option 631 will allow the driver to navigate in terms of time (as the route progressed). Current ranges of distance 621 and time 625 are shown as well, to aid in navigation. These ranges can be raised or lowered by means of the zoom in/out functions 623 627.

Such a display may also result if the driver requested speed at a specific time or over a range of times. Similar information might be shown, with the "marker" 611 designating the requested time or the center of a requested time range. If sufficient map data is available, the driver may also be able to navigate the display geographically by merely sliding a finger to "drag" the display.

Such information may be useful to a driver if, for example, the driver was pulled over at 9:17 for speeding and a ticket is issued. Since the ticket information typically includes a location of the offense and a time of the offense, the driver can use one or both of these pieces of data to determine if, in fact, the vehicle was traveling at the alleged rate of speed at or near the purported time or location of the offense. For example, if the driver was accused of traveling at 55 mph as the driver passed through the shown intersection, the driver would know that the officer likely saw a different vehicle or was mistaken in the accusation. It may be possible to produce a report, using saved data, for example, that shows the driver could not have been traveling at the accused speed at the moment of observation.

If the driver is concerned that the location may not be correct, the driver can scroll backwards and forwards in space and time to gauge the general rate of travel and driving information. For example, if the driver shows that a reasonable speed was maintained for all but a moment of the trip, when the driver was unluckily noticed, then it may be reasonable to assume that the driver had reasonably accelerated for a lawful purpose (avoidance, etc.) and immediately resumed a legal speed once the condition had passed. Without the data shown by this system, however, it will be difficult, if not impossible, for the driver to remember or, more importantly, prove, that such extenuating circumstances existed.

Figure 7:
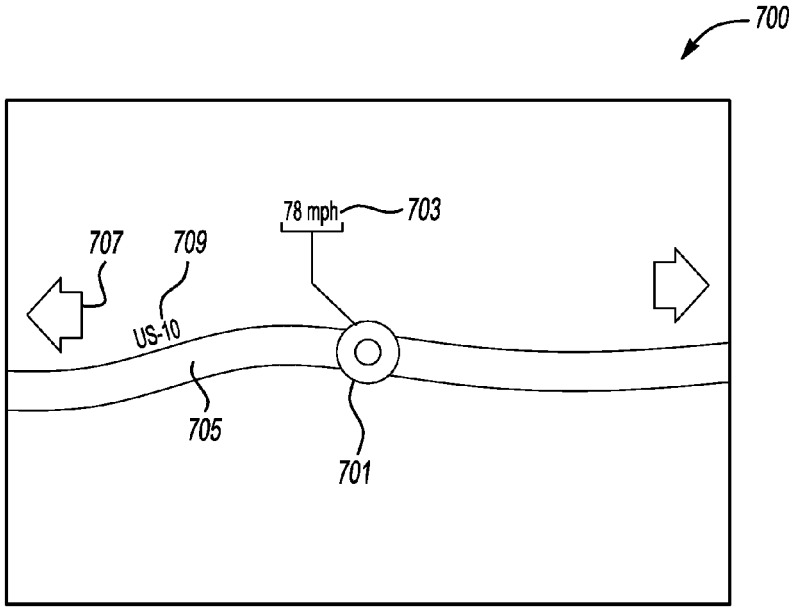
FIG. 7 shows an illustrative example of a max speed reporting display.

FIG. 7 shows an illustrative example of a max speed reporting display 700. In this illustrative embodiment, the driver has requested a display of where a maximum speed was obtained. As with the previous display, the location of the incident is shown by a marker 701 with accompanying speed data 703. Although not shown in this example, time data, GPS data and other data may also be displayed. Further, there could be data points leading up to and away from the max speed location that are also displayed. The road name 709 is displayed in this example, and the road itself 705 is also shown as part of the map data. In this embodiment, two arrows are provided on either side of the screen to allow the driver to navigate in space 707. This is just one alternative or additional feature that may be included in the display in addition to the navigation assistance panel 619 shown in FIG. 6.

This output might be desirable if the driver has been accused of traveling at a particular speed at which the driver does not believe was ever exceeded during the journey. By reviewing the point of maximum speed, the driver can confirm or dismiss this belief. Additionally, this data can allow a parent to see the maximum speed that was achieved by a child driving a vehicle, to determine if travel at a dangerous speed occurred.

Figure 8:
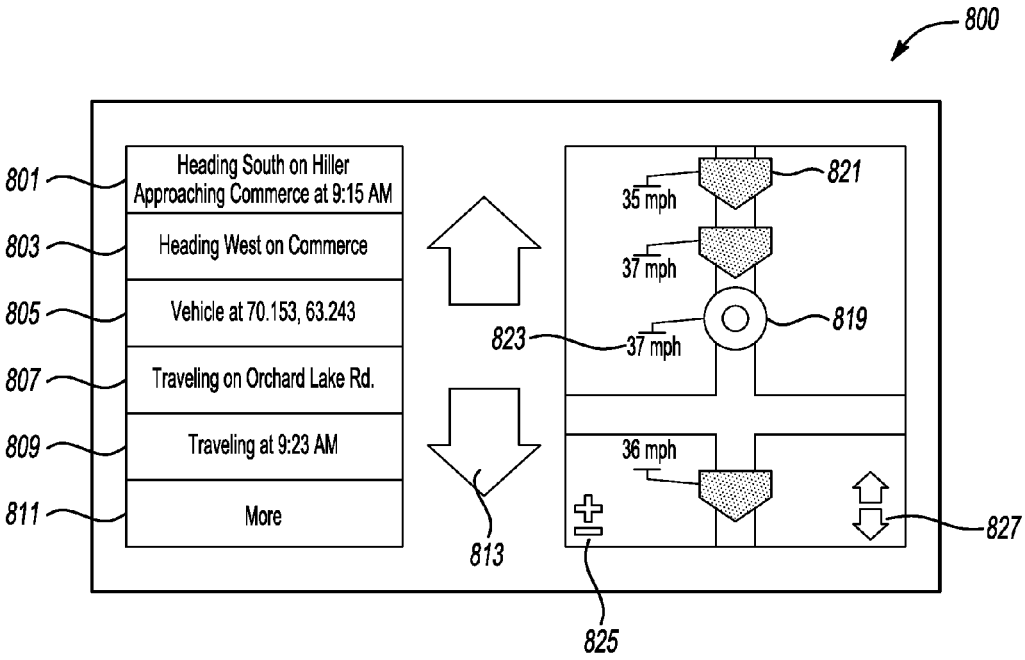
FIG. 8 shows an illustrative example of a speed exceeds X display.

FIG. 8 shows an illustrative example of a speed exceeds X display 800. In this illustrative embodiment, the driver has input a "speed limit" to the vehicle computing system. Using the saved data, the vehicle computing system compiles a list of all times when the speed of the vehicle was greater than the input limit. These points may be restricted in some manner, so as not to produce a large number of data points for the list if the speed was exceeded for a long period of time.

In one non-limiting example, each of the listed points 801, 803, 805, 807, 809, correspond to a range, the range being defined from where the speed limit was first exceeded to where the limit was decelerated past. In this manner, the driver is provided with a somewhat more concise (as compared to 1,000 data points) list of the points where this speed was exceeded. Similar to the maximum speed example, this query will show the driver all points along a route where a particular speed was reached, so the driver can determine, for example, if an alleged speed could actually have been witnessed where the officer alleges the speed occurred.

In this illustrative embodiment, once the data has been processed by the vehicle computing system, a list of the ranges meeting the criteria is output. The displays on this list may take numerous forms, a few are given here by way of example.

For example, display 801 shows the driver's heading, what crossroad was being approached, and the time of the incident. In these examples the time and location is keyed to the onset of the range, but different criteria may be used.

Exemplary display 803 simply shows the driver's heading and on what road the driver was traveling. Display 805 shows the actual GPS coordinates of the vehicle. Display 807 merely tells the driver on what road the vehicle was traveling at the time of the incidence. Display 809 tells the driver the time of the incidence.

Displayed information can be as complex or simple as desired. In this particular embodiment, the information is designed to give the driver a rapid reference point so that any desired, useful data can be quickly identified. For example, it may be the case that simply displaying the time or a road of travel is the fastest way to do this. On the other hand, it may be optimal to display the full range of information, such as is shown with respect to display 801.

Large arrows 813 allow the driver to quickly scroll through the data points when there are more 811 than can be shown on one display.

Selecting a data set, in this illustrative embodiment, results in the display of a small map showing the point of inception 819 and then rates of travel preceding and following that point 821. Speeds, time, GPS and other vehicle data may also be displayed 823 for each of the points. Navigation option items 825 and 827 may be used to zoom in or out, or scroll along the map accordingly.

It may also be the case that the range over which the speed was continuously exceeded is a large range. This range may still be displayed, and by zooming in or simply by touching an area on the map, a closer, smaller range may be observed.

Figure 9:
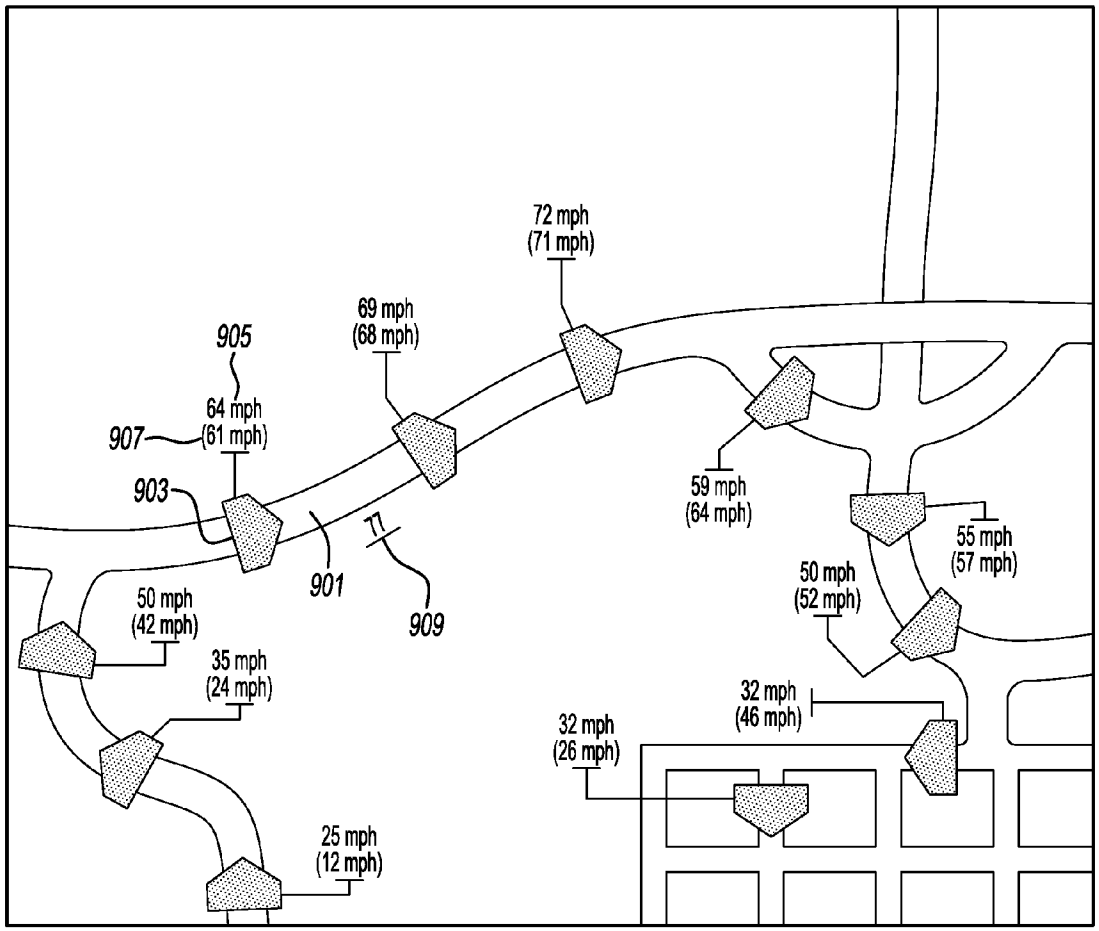
FIG. 9 shows an illustrative example of a whole route speed display.

FIG. 9 shows an illustrative example of a whole route speed display. In this illustrative embodiment, a whole route from start to finish is displayed on the vehicle display (or other display, or audibly output, etc). In this illustrative example, data points 903 are displayed periodically (typically in some rational manner related to the temporal length or physical distance of the trip). As with the previous data points, speed data 905 and other data (not shown) may be shown. In addition, in this embodiment, since the data points are representative of a range of data points in most cases (as it would likely be too crowded to shown all data for the entire trip on a single small display) an average speed 907 is also provided. This tends to show if the vehicle was accelerating or decelerating over the previous segment. Additionally or alternatively, a maximum speed over the segment 901 may be displayed 909. This may allow the user to selectively process certain segments where accelerated rates of travel were occurring.

In this illustrative embodiment, selection of a particular point may cause data surrounding that point to be displayed in a zoomed-in manner. Alternatively, selection of two points may alter the range from that of the whole trip to that of the two selected points. Additional, reasonable means of parsing and examining the data may also be administered.

Although the invention was described with respect to illustrative embodiment and examples, these were intended to be provided as examples only, and were not intended to limit the scope of the invention in any manner.

What is claimed:

1. A computer-implemented method comprising:

recognizing, via a vehicle computing system (VCS), the initiation of a vehicle journey;

periodically storing, via the VCS, vehicle speed data, GPS coordinate data and time data;

providing, via the VCS, at least one option for reporting the stored speed data, GPS data and time data; and responsive to input requesting the reporting, outputting the stored speed data, GPS data and time data, via the VCS, for at least one portion of the vehicle journey.

2. The method of claim 1, wherein the recognizing further comprises determining that a vehicle speed exceeds a predetermined threshold.

3. The method of claim 1, wherein the periodically storing further includes storing data at least each time a new maximum vehicle speed is achieved.

4. The method of claim 1, wherein the periodically storing further comprises storing the data at predetermined time intervals.

5. The method of claim 1, wherein the periodically storing further comprises storing the data at predetermined GPS coordinate intervals.

6. The method of claim 1, wherein at least one option for reporting further includes an option to view speed data proximate to a specific intersection or portion of a route.

7. The method of claim 6, wherein selection of the option to view speed data proximate to a specific intersection or portion of a route results in output of data representing a plurality of speed data points, proximate to an input intersection or portion of a route.

8. The method of claim 1, wherein at least one option for reporting further includes an option to view speed data proximate to a specific time or time range.

9. The method of claim 8, wherein selection of the option to view speed data proximate to a specific time or time range results in output of data representing a plurality of speed data points, proximate to an input time or time range.

10. The method of claim 1, wherein at least one option for reporting further includes an option to view speed data over a certain speed limit.

11. The method of claim 10, wherein selection of the option to view speed data over a certain speed limit results in output of data representing a plurality of speed data points, where recorded speeds met or exceeded an input speed limit.

12. The method of claim 1, wherein the outputting further comprises visually outputting information on a navigation display.

13. The method of claim 1, wherein the outputting further comprises uploading information to a remote storage location.

14. The method of claim 1, wherein at least one option for reporting further includes an option to view speed data for an entire route.

15. The method of claim 14, wherein selection of the option to view speed data over an entire route results in output of data representing a plurality of speed data points, representative of at least a plurality of speeds achieved over travel along the entire route.

16. The method of claim 15, wherein the speed data points represent an average speed between successive data points.

17. A vehicle computing apparatus comprising:

recognizing programmed logic circuitry to recognize the initiation of a vehicle journey;

storing programmed logic circuitry to periodically store vehicle speed data, GPS coordinate data and time data;

providing programmed logic circuitry to provide at least one option for reporting the stored speed data, GPS data and time data; and outputting programmed logic circuitry to output the stored speed data, GPS data and time data for at least one portion of the vehicle journey, responsive to input requesting the reporting.

18. The apparatus of claim 17, further comprising determining programmed logic circuitry to determine that a vehicle speed exceeds a predetermined threshold, thus signaling the initiation of a vehicle journey.

19. A computer readable storage medium, storing instructions that, when executed, causes a vehicle computing system (VCS) to perform the method comprising:

recognizing the initiation of a vehicle journey;

periodically storing vehicle speed data, GPS coordinate data and time data;

providing at least one option for reporting the stored speed data, GPS data and time data; and responsive to input requesting the reporting, outputting the stored speed data, GPS data and time data for at least one portion of the vehicle journey.

20. The computer readable storage medium of claim 19, wherein the periodically storing further includes periodically storing additional vehicle data.

* * * * *